United States Patent [19]

Paar et al.

[11] 4,149,253

[45] Apr. 10, 1979

[54] SOIL COMPACTING APPARATUS

[75] Inventors: Alois Paar, Cologne; Fritz Konig, Wuppertal-Elberfeld, both of Fed. Rep. of Germany

[73] Assignee: Losenhausen Maschinenbau AG, Dusseldorf-Grafenberg, Fed. Rep. of Germany

[21] Appl. No.: 740,260

[22] Filed: Nov. 10, 1976

Related U.S. Application Data

[62] Division of Ser. No. 390,512, Aug. 22, 1973, abandoned, which is a division of Ser. No. 199,275, Nov. 16, 1971, abandoned.

[30] Foreign Application Priority Data

Nov. 21, 1970 [DE] Fed. Rep. of Germany ..... 2057279

[51] Int. Cl.[2] ..... G05B 11/06; E01C 19/28

[52] U.S. Cl. ..... 364/505; 364/424; 404/84; 404/117; 404/122

[58] Field of Search ..... 404/117, 84, 122, 133; 364/505, 506, 508, 424, 425

[56] References Cited

U.S. PATENT DOCUMENTS

| | | | |
|---|---|---|---|
| 3,283,679 | 11/1966 | Rafferty | 94/50 |
| 3,444,727 | 5/1969 | Bourdin et al. | 73/78 |
| 3,797,954 | 3/1974 | Harris | 404/117 |

FOREIGN PATENT DOCUMENTS

| | | | |
|---|---|---|---|
| 659237 | 3/1938 | Fed. Rep. of Germany. | |
| 822979 | 10/1951 | Fed. Rep. of Germany. | |
| 852667 | 8/1952 | Fed. Rep. of Germany. | |
| 1634616 | 7/1970 | Fed. Rep. of Germany. | |
| 222708 | 7/1968 | U.S.S.R. | 73/84 |

*Primary Examiner*—Felix D. Gruber
*Attorney, Agent, or Firm*—Darbo & Vandenburgh

[57] ABSTRACT

A soil compactor has (1) an apparatus preceding it to measure characteristics of the soil significant to the compaction operation, and/or (2) an apparatus following it to measure characteristics of the soil after compaction. The soil compactor has one or more controls over the compaction operation. The controls are operated in accordance with the measurement indications of said apparatus.

11 Claims, 28 Drawing Figures

$(x+y)^2 - (x-y)^2 = 4xy$

SOIL COMPACTING APPARATUS

RELATED APPLICATION

This application is a division of our prior application Ser. No. 390,512, filed Aug. 22, 1973, now abandoned, which was a division of our prior application Ser. No. 199,275, filed Nov. 16, 1971, now abandoned.

BACKGROUND AND SUMMARY OF THE INVENTION

The invention relates to soil compacting apparatus in which one or more operational characteristics such as the rotational speed of the exciter, the unbalance, the direction of force or the traveling velocity may be varied and which has measuring means and adjusting means for varying the operational characteristics, which adjusting means may be influenced in accordance with the signal delivered by said measuring means.

Soil compacting apparatus, in particular apparatus in which the soil is compacted by vibrations, such as plate vibrators and rollers with vibrating barrels are frequently provided with systems, known in the prior art, by means of which the kind, magnitude and duration of the effects produced by the apparatus on the soil which is to be compacted may be adjusted either in steps or continuously; for example, such systems may vary the velocity at which the apparatus is driven or pulled over the soil which is to be compacted or they may vary to the magnitude of the centrifugal force exerted by such apparatus. The said force may be altered in compacting apparatus with unbalance excitation by means of the unbalance, the excitation rate being retained, and it may also be varied together with the rotational speed of the exciter; it is also possible to vary the unbalance and rotational speed of the exciter relative to each other so that a new vibrator frequency is obtained with the same vibration intensity. In addition to varying the aforementioned two characteristics it is also possible to vary the principal direction of the centrifugal force of a working part, either by pivoting the exciter or by phase displacement between the rotors in the case of exciters with two or more mass force generators. The phase relationships of the vibrations of soil compacting apparatus with a plurality of working parts may also be varied, for example in a first setting to produce a simultaneous maximum action on the soil or in a second setting to produce an alternating effect.

Experience has shown that the kind of soil compacting apparatus, which may be adjusted in the manner described hereinabove, do not provide optimum compacting results on all soils if the previously mentioned operating parameters are fixedly defined, but that instead it is advantageous for a high vibration frequency to be applied to one soil while a low centrifugal force is more advantageous for another soil and a sliding rather than pressing stress is more advantageous for yet another soil. Manufacturers of dynamic soil compacting apparatus therefore provide adjusting means of the kind mentioned heretofore to provide a wider range of applications for such apparatus and to render them universally usable.

In practice there are however substantial difficulties which militate against the envisaged technical progress being achieved. The first and basic reason is due to the fact that the relationships between the action produced by the compacting apparatus on the soil and the displacement phenomena which occur as the result of such action are substantially unknown: according to the prior art, the user is not yet in a position to optimize the vibrator frequency of the apparatus in accordance with accessible soil properties such as particle distribution and water content based on experience or in terms of a mathematical formula.

A further reason is due to the relationship between the vibration technological characteristics of the soil compactor and a change, for example, of the centrifugal force. Most dynamic soil compacting apparatus operate by so-called "jump" progress, that is to say, the exciter force raises the working parts from the soil in certain phases; the parts then perform a ballistic motion initiated by the exciter force and strike the ground at a moment of time which is defined substantially by the laws of free fall, at which time the exciter force is not necessarily orientated towards the soil. This synchronism between impact pulse and simultaneous exciter force, frequently desirable for intensive compacting, can be disturbed by even slight changes - including increases - of the unbalance or centrifugal force so that the "so-called" jump characteristics of the affected working part which defines compaction may experience fundamental changes which cannot be quantitatively controlled.

Finally, there are also certain properties of the bulk itself which is to be compacted which may prevent the desired success being achieved even if the aforementioned problems are assumed to have been solved. The intrinsic dry bulk density of a dumped material fluctuates, rarely less than 3% and frequently more than 5% and this also applies to local differences of water content. The initial fluctuations are retained almost unchanged after final compactions at Proctor values not substantially in excess of 100% if the dumped material is uniformly worked with a compacting apparatus; the final density, assuming a uniform initial bulk density, is practically proportional to the local water content since this, in the same way as in the Proctor test, has a noticeable effect on the compaction achieved with a defined compacting energy. If steps are to be taken to ensure that minimum dry bulk weight values are obtained for a given compacting problem, these fluctuations must be added to the test value, which, although it amounts to only a few percent, nevertheless results in a substantial increase of the work input.

Proposals have been made according to which the adjustment of suitable machine parts or the variation of their characteristic values is related to measured values which are recorded during the compacting operation. A first apparatus of this kind comprises a seismic acceleration pick-up disposed on a working part, subjected to superimposed loading, and manually operated means for varying the rotational speed of the exciter; it is desirable for the said rotational speed to be maintained at or close to the value at which the acceleration pick-up delivers its maximum signal, that is to say, the system comprising the working part and the soil being approximately at resonance under the effect of the periodic exciter force. The disadvantages of this solution to the problem are not only the basic limitation to the control of superimposed load working parts - resonance conditions do not apply to jump operation either in terms of appearance or by way of concept - but also the fact that co-control of the exciter force through the rotational speed and due to the frequently super-critical damping resulting from friction in the soil it is not possible for the resonance to become sufficiently clearly defined and in these cases there is no adequately significant matching criterion for manual regulation.

It has also been proposed to measure the impact energy of a dynamic soil compacting apparatus component which functions in jump operation for the purpose of controlling the traveling velocity of the apparatus relative to said measurement. A common feature of the proposals is the idea of utilizing the operating characteristics of the compacting apparatus as a controlled condition in terms of process control technology, the compactness produced by the apparatus being the "desired value". Such solutions to the problem suffer from the defect that the relationship between the "desired value" and the appropriate controlled condition is hypothetical because, despite intensive research, it has not been possible to establish a generally valid relationship between the dry bulk density of a soil on the one hand and the vibration characteristics of a dynamic compacting apparatus operated on said soil. Apparatus of this kind therefore merely shift the problem of determining suitable operational parameters of the compacting apparatus, that is to say, defining the relationship between these two magnitudes in a specific, individual case. Although progress is achieved, the problem is not yet solved but its extent is merely limited and expressed in concrete terms.

The object of the present invention is to provide means for varying the operating parameters of soil compacting apparatus during operation based on measurements but in conditions which are free of previous limitations; this includes primarily the process-dependent relationship to the superimposed loading or "jump" operation of the compacting apparatus or its working parts and the condition of validity of the relationships between measured value and "desired value" which must be defined, tested and allowed for independently of the apparatus in question.

The invention is based on the idea to arrange the methods for recording measured values so that on the one hand they become independent of the vibration characteristics of the apparatus or its working parts and on the other hand can be related to soil characteristics, relevant to output, more directly than this is possible according to the prior art.

In this sense it is a further object of the invention to differentiate the solution of the general problem in accordance with different performance features, for example, relative to the compressive strength or shear strength in addition to the compactibility.

According to the basic idea of the invention, the measuring means are constructed as measuring transducer for physical soil characteristics of the soil which is to be compacted or which is to be partially or solely compacted.

According to the invention, the vibration characteristics of the soil compacting apparatus are not utilized as controlled condition as in the prior art but the physical soil characteristics themselves are utilized to function as controlled condition.

The invention may be performed by trailing measuring means being provided which are constructed as measuring transducers for detecting physical soil characteristics after a pass of the soil compacting apparatus. This is not genuine regulation since the soil compactor operation characteristics, influencing the compaction of the soil which is to be freshly compacted, are varied in accordance with the characteristics of the soil which has already been compacted, this change of the operating characteristics of course having no further effect on the characteristics of the soil which is already compacted. Nevertheless, the method may be employed since generally it is possible to assume a degree of constancy of the soil characteristics.

The trailing measuring means may be constructed as measuring transducer for one or more of the following physical soil characteristics after the passage of the compacting apparatus or individual working parts thereof:

(a) compactibility
(b) coefficient of soil reaction
(c) shear strength
(d) continuous vibration impedance
(e) pulse or impact impedance
(f) penetrometric properties of the soil surface
(g) set of the soil surface.

One or more command signals may be transmissible to the final control means in the manner of command values in process control technology, the signals of the measuring transducers and the command signals being connected in opposition to each other in an adding stage and, where appropriate, being adapted to act through a control amplifier on the final control means.

Finally the object of the invention is to achieve the desired advance, possible, according to the prior art, only by utilizing hypotheses on the relationship between the measured value and the desired value by adopting a solution to this problem of the unknown part of the controlled apparatus.

In this connection the invention is based on the principle that advantageous or optimum adjustment of the operational parameters of dynamic soil compacting apparatus cannot be achieved with means and models of conventional process control technology owing to the special features of the particular art in question. Process control technology is based throughout on a knowledge of the relationship between measured value and final control value, that is to say, the characteristic of the controlled apparatus and only in this way is it possible for the control deviation to form the final control value which will sensibly drive the functional value in terms of magnitude and direction to the reference value. In the present case, the soil to be compacted represents at least part of the controlled apparatus and is therefore variable not only from building site to building site but also within individual compacting areas and furthermore it has a noticeable effect on the operating characteristics of the apparatus and moreover defines its reaction to changes of the final control element, for example, the throttle of the prime mover for controlling the rotational speed.

A further embodiment of the invention therefore provides that supplementary signals of very low frequency may be additively superimposed on the command signals and a transfer signal is formed by a multiplier from the changed command signal and the measuring transducer signal changed thereby through the controller and the controlled part of the apparatus, the said transfer signal being adapted to vary the transfer coefficient of the controller through another multiplier.

The following means may be used for measuring the compactibility of the soil before, after and during the pass of the compacting apparatus:

Radio isotope measurements with gamma rays; in this measuring system a receiver measures the intensity of the reflected radiation which expresses the moist bulk density of the soil by reference to a relationship which must be empirically determined and which is practically independent of the soil. Since it is not necessary for these means to be manually moved it is possible for shieldings to be thicker than those of conventional field probes and accordingly it enables sources to be employed which have activities higher than 20 mC and thus enable the integration periods for the receiver pulses to be reduced. This method may be combined in known manner with corresponding measurement of back scattered thermal neutrons to enable the dry bulk weight to be displayed.

Measurement of the electric soil resistance by means of a four-probe system. The said four-probes are preferably formed by four substantially disc-shaped members with semicircularly radiused edges, electrically insulated from each other and guided on a common shaft. They are rolled over the measuring position with a corresponding slight pressure. The current passing through the outer probes and required to maintain a controlled voltage between the inner probes is a clear measure for the dry bulk weight if the water content is known.

A test ram or a test baulk, bearing hydraulically on soil at a defined pressure, for example 5 kgf/cm$^2$, may be used as means for measuring the compactibility coefficient of the soil (elastic constant referred to the loaded surface) the amount of set being recorded and stored by a transducer on the baulk guide from the initial contact to approximately 5 seconds after full load is reached. To otain a rapid sequence of such measured values it is possible for a plurality of test baulks of the kind heretofore described to be disposed on the circumference of a hydraulically operated measuring cylinder - individually freely rotatable over corresponding angular ranges.

A plate or baulk, placed on the ground at a pressure of approximately 1 kgf/cm$^2$ and then retained in its vertical position is suitable as transducer for measuring the shear strength of the compacted soil. The measuring transducer in the more closely defined sense is a dynamometer for defining that force, applied to the said plate by the compacting apparatus or by the tractor, at which the said plate begins to move (in the direction of the force) relative to the adjacent soil surface. The barrel of a roller, rolling with moderate pressure on the soil and driven by an unbalance exciter, may be used for measuring the continuous vibration impedance. In acceleration pick-up with a vertical operating direction defines the accelerations of the measuring roller and therefore also of the soil under the effect of the alternating harmonic force transmitted under the effect of the exciter; the ratio of these two magnitudes is the impedance of the soil.

The pulse or impact impedance is the reciprocal of the Laplace-transformed derivation of the weight function (referred pulse response). The zones of minimum frequency, corresponding to those time intervals from the pulse time at which the deformation velocity becomes zero, that is to say, when the soil begins to swing back, are of significance for a knowledge of the soil characteristics. If the soil is hard-elastic, these periods will be short. If on the other hand the soil characteristics vary from plastic to plastic-flowing, these periods of time will be long to practically infinite. The values may be measured by attaching a velocity pick-up on a drop weight, the said velocity pick-up being adapted to operate an integrating member from the time of impact to the time at which its output signal becomes zero; the measured value is the appropriate final value of said integrator.

Penetrometric soil properties can also be measured by a system incorporating a cylinder which rolls under a certain thrust on the soil, the cylinder barrel having teeth or spikes surmounted upon it which, under the applied thrust, penetrate to a greater or lesser depth into the surface of the soil. The penetration depth is measured by a distance transducer, for example, as the distance between the axis of such a spiked cylinder and a smooth cylinder, guided axially parallel thereto and also rolling on the soil.

It is not usually possible to base the operation of soil compacting apparatus which is to be suitable for any kind of material to be compacted, on a knowledge of the characteristics of the controlled system. It is therefore not possible to predict the sense in which the operating characteristics of the apparatus, for example, the unbalance, must be changed in the event of a deviation of the measured soil characteristics from a set value in order to cause such deviation to disappear. Modulation of the command variable in conjunction with multipliers for automatically changing the control characteristics will be utilized in the above described manner for such apparatus. It is also possible for multi-purpose apparatus to be provided which can be switched to different pre-programmed control characteristics for the purpose of adaptation to different materials if the effect of a change of operating characteristics on the achieved compaction is known. Finally, it is also possible for single-purpose machines to be provided which are intended for use on soils with a uniform or rather similar relationship to one operating characteristic and in which the regulating direction and slope of regulating direction are designed and defined with respect to the purpose of the apparatus. Finally, it is also possible for leading measuring means to be provided, said means being constructed as a measuring transducer in front of the compacting apparatus or the first working member thereof for one or more of the following soil-physical characteristics:

(a) Compactibility (b) Water content and that the signals of the leading measuring means may be applied to the regulating means in the sense of disturbance-variable feed-forward.

DESCRIPTION OF SPECIFIC EMBODIMENTS

Figure 1:
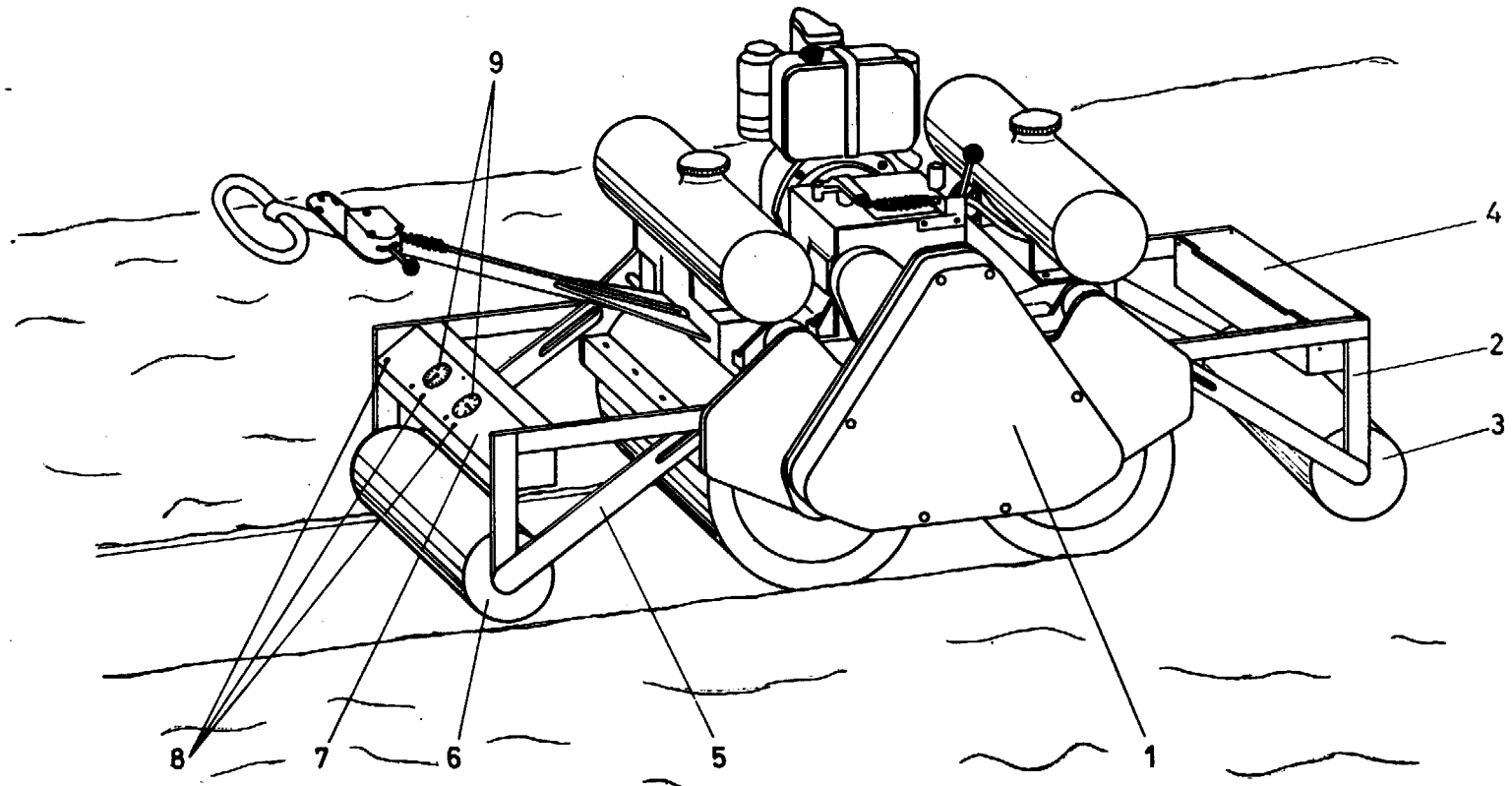
FIG. 1 is a diagrammatic perspective view of a dynamic soil compacting apparatus according to the invention.

FIG. 1 shows a basic embodiment of the invention. The soil compacting apparatus to be controlled in this case is a known double vibratory roller 1, the rollers thereof forming compacting elements. At its front it guides leading measuring means 3 mounted on a frame 2 which may be pivoted upwardly. The measuring means shown in FIG. 1 is not detailed. It may, for example, be provided for measuring the compactibility of the soil being worked. Auxiliary apparatus required for functioning of the measuring means 3 are disposed in the enclosed container 4, in particular the electronic system required to this end.

At its rear the compacting apparatus 1 has trailing measuring means 6 mounted on a frame 5. This measuring means may comprise apparatus for mesuring one or more of the seven soil characteristics hereinbefore listed in subparagraphs (a) to (g) of the Background And Summary of the Invention. The measured values generated thereby either as such or in conjunction with the measured values provided by leading measuring means 3 are processed to yield control signals in apparatus disposed in the container 7 which is also provided with setting means or controls 8 and indicating means 9 which are in the field of view and within operating reach of the driver of the apparatus. Furthermore, the signals supplied to the indicating means 9 may also be utilized for generating the control signals for automatic control or regulation, for example, of the traveling speed of the compacting apparatus 1.

Figure 2:
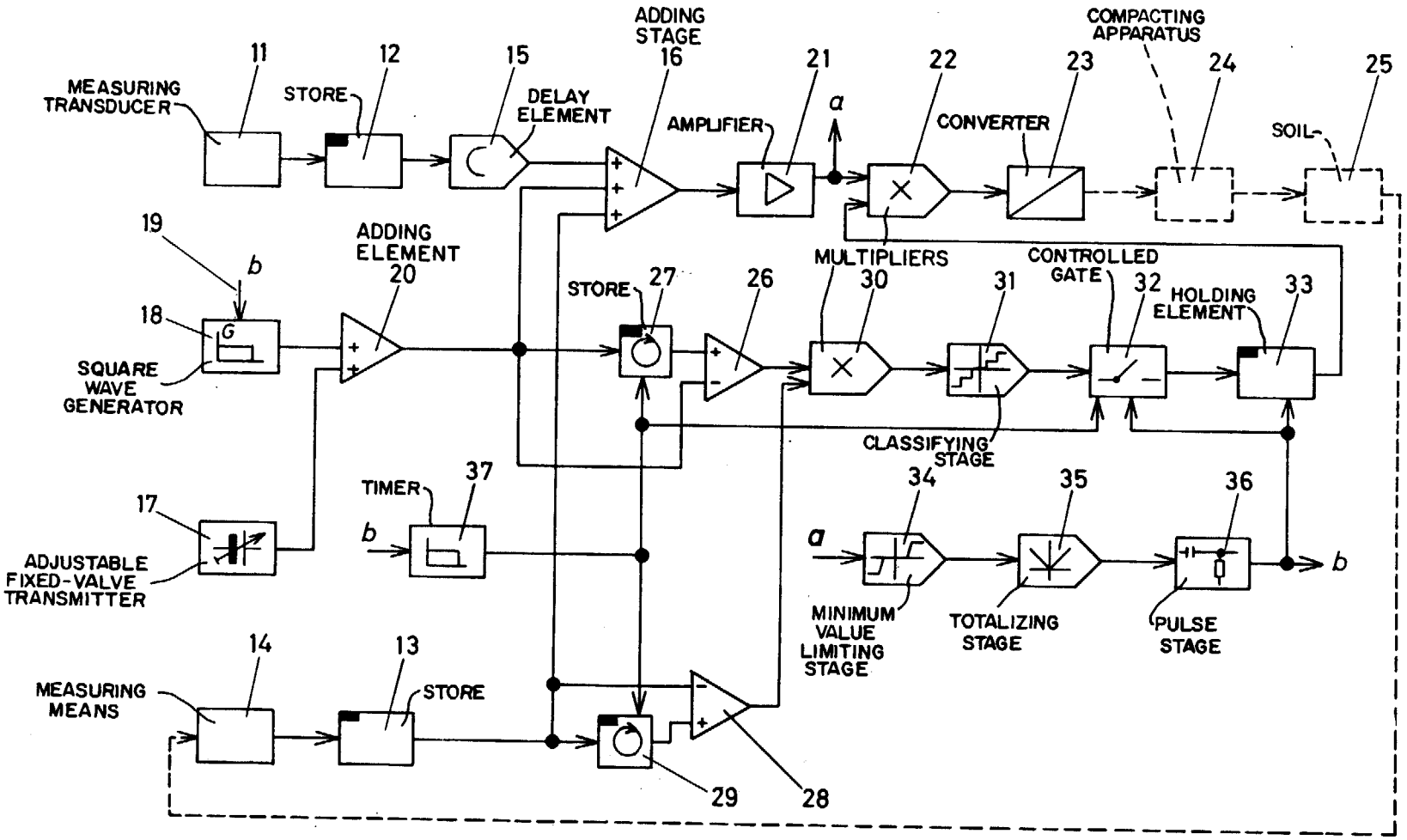
FIG. 2 is a signal flow diagram symbolically representing the measuring and control system elements in the apparatus according to the invention.

FIG. 2 is a general signal flow chart according to the basic idea of the invention. The numeral 11 refers to a measuring means in accordance with leading measuring means 3 of FIG. 1. The output signal of said measuring means is supplied to a store 12 which receives and maintains that signal until a succeeding measured value is established. Another store 13 is associated with the measuring means 14, which is a trailing measuring means such as that illustrated at 6 in FIG. 1. A number of specific types of measuring means usable for measuring means 14 is subsequently discussed in connection with FIGS. 6–7, 8, 9–11, etc. Before use the output signals from the sensor thereof are suitably processed by a processing circuit, as for example FIG. 13. Store 13 receives and maintains the measured values (actual value signal) from measuring means 14 until the succeeding measured value is established. The contents of the store 12 are transferred to an adding stage 16 through a delay element 15, the delay period of which corresponds to the time required for the apparatus to travel over the distance between the leading and trailing measuring means. The signals from the store 13 are also supplied to the aforementioned adding stage. An adjustable fixed-value transmitter 17 generates the command signal. A generator 18 produces individual squarewave pulses having a duration of, for example, 8 seconds. Generator 18 is triggered through its starting input 19. The outputs of the fixed-value transmitter 17 and of the genertor 18 are also supplied to the adding stage 16 through an adding element 20.

In terms of process control technology, the three inputs of the adding stage 16 have the following significance. Data from the store 13 represents the actual value of the automatic control. Data supplied from the delay element 15 represents a form of disturbance-variable feed-forward. The signal of the fixed-value transmitter 17 corresponds to the command variable of the automatic control and the output signal of the generator 18 corresponds to a command variable feed-forward.

After being subjected to intermediate amplification in an amplifier 21, the output signal of the adding stage 16 is supplied to the first input of a multiplier 22. The output thereof acts on the soil compacting apparatus 24, like the one shown in FIG. 1, through a converter 23 which, in terms of process control takes the form of a final control drive, the said apparatus 24 by virtue of its compacting function varying the soil 25 to yield the actual value of the process control function as represented by measured signal from the measuring means 14. The basic control circuit included in FIG. 2 therefore comprises the units 14, 13, 16, 21, 23, 24 and 25. In the simplest embodiment of the invention (for single-purpose machines with manual control) the multiplier 22 may take the form of an indicating instrument for the output signal of the intermediate amplifier 21 and the converter 23 may take the form of manual adjusting means like indicating means 9 and controls 8 in the double vibratory roller 1 as shown in FIG. 1. The fixed-value transmitter 17 in this embodiment will then also be replaced by a mark on the indicating instrument. In single-purpose machines with automatic control the output signal of intermediate amplifier 21 is fed to the first input of the multiplier 22, the second input of which is provided with a fixed voltage transfer signal (from a transfer signal generating means, not shown) so that this component transfers data to the converter 23 under fixed transfer conditions. In multi-purpose machines the transfer characteristics of the multiplier 22 are varied by a variation in the fixed voltage supplied to the second input so that a plurality of discrete characteristics are obtained.

In the embodiment for multi-purpose machines the second input value of the multiplier 22 is formed in the following manner, utilizing the square-wave generator 18. The lower input of the differential amplifier 26 is supplied with the instantaneous value of the command variable, formed by the adding amplifier 20, the second input being supplied by a value of this quantity which is delayed by the store 27. Corresponding conditions apply to the differential amplifier 28 and the store 29, but in this case with respect to the measured value signal from the measuring means 14 of the trailing measuring means 6 instead of with respect to the command variable. The output quantities of the differential amplifiers 26 and 28, supplied to the further multiplier 30, therefore correspond to the differences between the instantaneous value of command variable and the measured (actual) value with respect to the values possessed by these quantities at an earlier moment of time, defined by further structural components which will be described hereinbelow. The multiplier 30 forms an output signal which substantially corresponds to the product of these two differences and which is supplied to the input of a classifying stage 31. The product signal, thus graded, is supplied through a controlled gate 32 to a holding element 33 and from there to the second input of the multiplier 22.

The controlled condition, as yet unevaluated, is tapped off from the position designated with the letter a between the amplifier 21 and the first multiplier 22 and is supplied to a minimum value limiting stage 34. The signal then passes through the succeeding totalizing stage 35 to a pulse stage 36. A pulse b will occur at the output of the pulse stage whenever the unevaluated controlled condition a is exceeded by a defined amount which, in the sense of automatic process control technology, may be described as a permissible deviation. At first, this pulse will set the output of the holding element 33 to a fixed value which is independent of the remaining quantities of the control system; furthermore, the pulse will also drive the gate 32 and start a timer 37 which defines the duration of the command variable feed-forward. The stores 27 and 29 are reset when an output signal appears on the timer 37, the said stores being set to receive signals for the measured value and the command variable. Disappearance of the output signal of the timer 37 also causes the gate 32 to be driven to cut off. The pulse also starts the generator 18 via the input 19 to form the command variable feed-forward signal.

Figure 4:
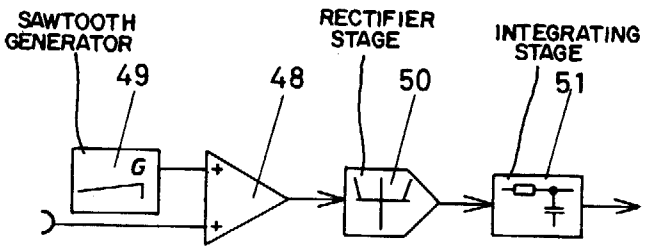
FIG. 4 is a schematic showing a squaring element which may be used for the correlator according to FIG. 3.
Figure 3:
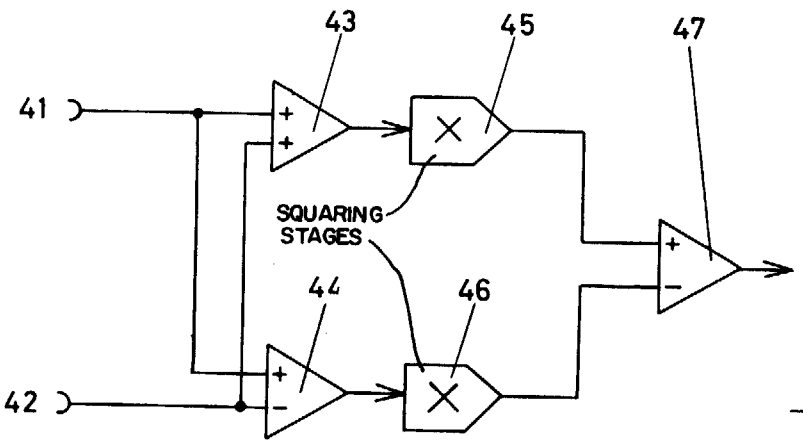
FIG. 3 is a schematic of a correlator used in the apparatus according to FIG. 2.

FIG. 3 is a basic system of the multipliers 22 and 30 employed in the control system as shown in the flow chart of FIG. 2. The voltages supplied to the two inputs 41 and 42 of such a multiplier are supplied to an adding stage 43 and a differentiating stage 44 and from there via squaring stages 45 and 46 to a differentiating stage 47. The function of such a stage is determined by the fact that the pure squares of the input values cancel each other in the terminating differentiating stage and the mixed products are added. FIG. 4 shows a possible embodiment of the squaring stages. In this case, the signal to be squared is first superimposed in an adding stage 48 on the output signal of a saw tooth generator 49, the frequency of said generator being higher by one order of magnitude or more than the characteristic frequency of the signal which is to be squared. The output signal of the adding stage 48 is supplied to a rectifier stage 50 with minimum value suppression, so designed that the suppressed zone corresponds to the sweep of the saw tooth generator 49. The proportions of generator voltage of higher frequency are filtered out from the square of the measuring voltage thus obtained in the succeeding integrating stage 51. The squaring function of such a stage is obtained by virtue of the fact that the saw tooth voltage of the generator 49 cannot pass through the rectifier 50 when the measuring voltage disappears, but if a non-disappearing measuring voltage is superimposed, those peaks of the generator voltage the amplitude of which corresponds to the instantaneous value of the measuring voltage will pass through the rectifier 50. The timing characteristics of the voltage peaks thus produced on the output of the rectifier 50 represent similar triangles the height of which corresponds to the measuring voltage. According to a known principle of geometry, the areas of these triangles, that is to say the charges transmitted by the said pulses and therefore the voltages which appear across the integrating capacitor, vary as the squares of the heights of the triangles.

Figure 5:
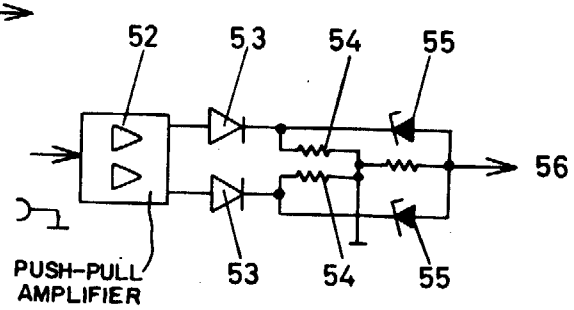
FIG. 5 schematically shows a rectifier adapted for suppressing minimum values and as usable in the circuit of FIG. 4.

FIG. 5 show a possible embodiment of such a rectifier 50 with minimum value suppression. Together with the push-pull amplifier 52 and the two rectifiers 53 it initially represents a known full-wave rectifier. The half-wave voltages which appear across the working resistors 54 of said rectifier are isolated from the stage output 56 within the limiting zone by means of zener diodes 55 and are generally transferred to the output 56 only with that voltage proportion by which they exceed the breakdown voltage of the zener diodes 55.

Figure 6:
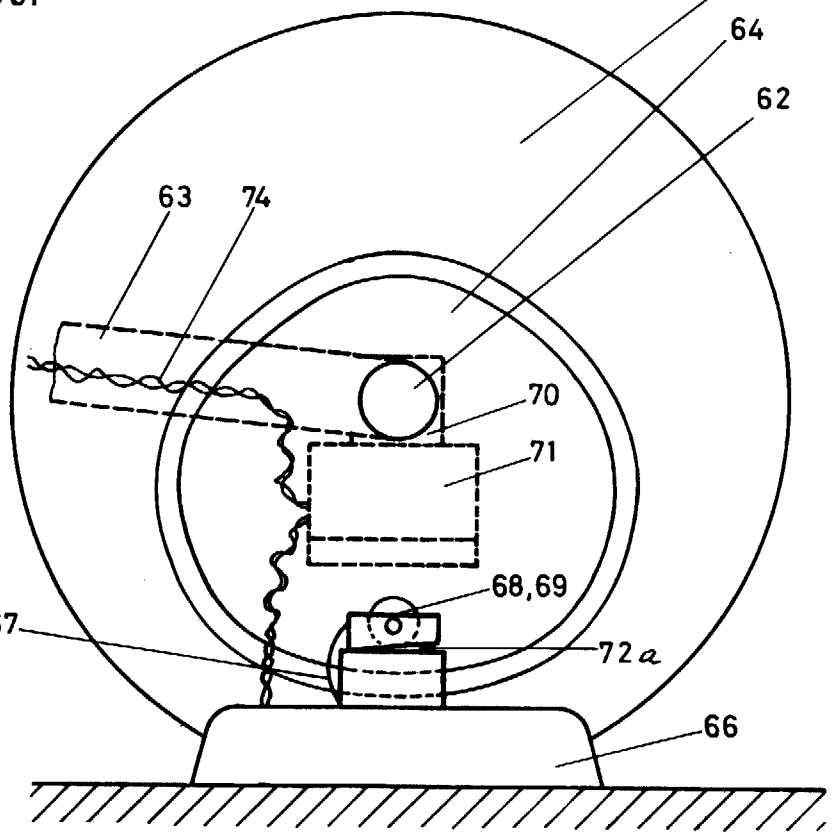
FIG. 6 is a side view of an embodiment for defining the moist bulk weight by means of radio isotope measurement for use with soil compacting apparatus according to the invention.
Figure 7:
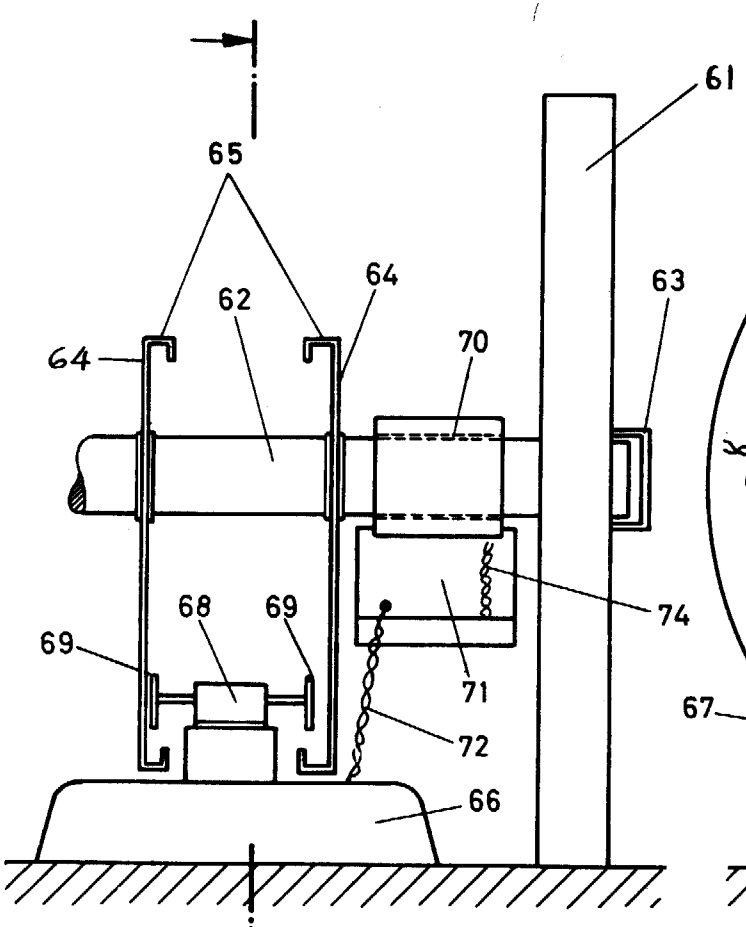
FIG. 7 is a front view of the embodiment of FIG. 6.

FIG. 6 and 7 show an embodiment of trailing measuring means for determining the moist specific gravity of the soil by radio isotope measurment. The trailing measuring means are formed by in a single-axle trailer formed by the wheels 61, the shaft 62 and the drawbar 63. Two disc cams 64, the outer edge 65 of which is circular over a wide angular zone and extends more closely to the axis of the apparatus in the remaining angular zone, is coupled to the shaft 62. A roller support 68, the supporting rollers 69 of which are adapted to engage in the inner running surfaces of the disc cams 64 is mounted on the surface probe 66 by means of a powerful leaf spring 67. The counting apparatus 71 is mounted on a pivoting support 70 on the shaft 62 adjacent to the aforementioned disc cam 64, the counting pulses being supplied to said counting apparatus 71 through a lead 72 from the probe 66. The roller support 68 of the supporting rollers 69 is also provided with a contact transmitter 72*a* from which a control signal is supplied to the counting apparatus 71 when the disc cams 64 release the supporting rollers 69 and the probe 66 is disposed freely on the coil surface. In operation the disc cams 64 periodically raise the surface probe 66, convey it forward and deposit it for a defined period of time (dwell) on the soil surface. During this dwell period of the probe 66 the input of the counting apparatus 71 is rendered conductive by the signal of the contact transmitter 72*a* so that the counting apparatus is able to transmit the counting rate, corresponding to the moist specific gravity of the soil, through the signal conductor 74 to the measuring and control system elements according to FIG. 2.

Figure 8:
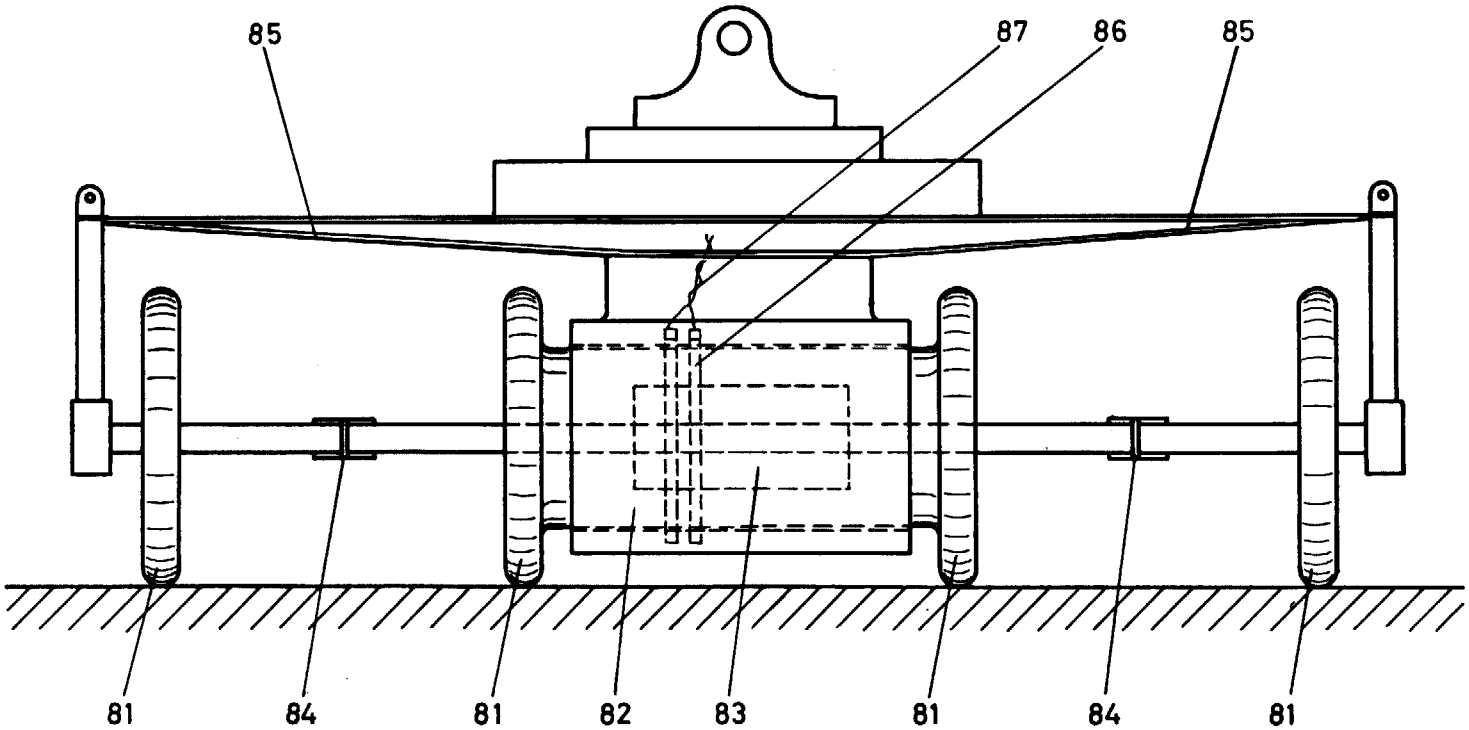
FIG. 8 is a front view of measuring means for the continuous measurement of the dry bulk weight or of the water content of the soil by means of an electrical measuring method.

FIG. 8 is an embodiment of measuring means which may be employed as leading as well as trailing measuring means for continuously determining the dry specific gravity or the water content of the soil according to an electric measuring method. The measuring means is also constructed in the form of a single-axle trailer, the four running discs 81 also representing the measuring probes. Of these four discs, the two inner running discs represent the voltage probes; they are fixedly joined to each other by means of a cylindrical support member 82 in which the battery-operated electronic circuit 83 design is accommodated. The two coaxially disposed outer current probes are guided by torsion-resistant and flexible axle coupling elements 84 so that a uniform soil contact of all four running discs 81 is obtained in conjunction with the forces of the leaf springs 85 which act on the outer ends of the axle. The signal, delivered in this embodiment through the slip rings 86 and the signal conductor 87 corresponds to a current flow through the outer probes required for a controlled and maintained voltage between the inner probes and, as is known, is a direct measure of the dry specific gravity of the soil when the water content is known.

Figure 9:
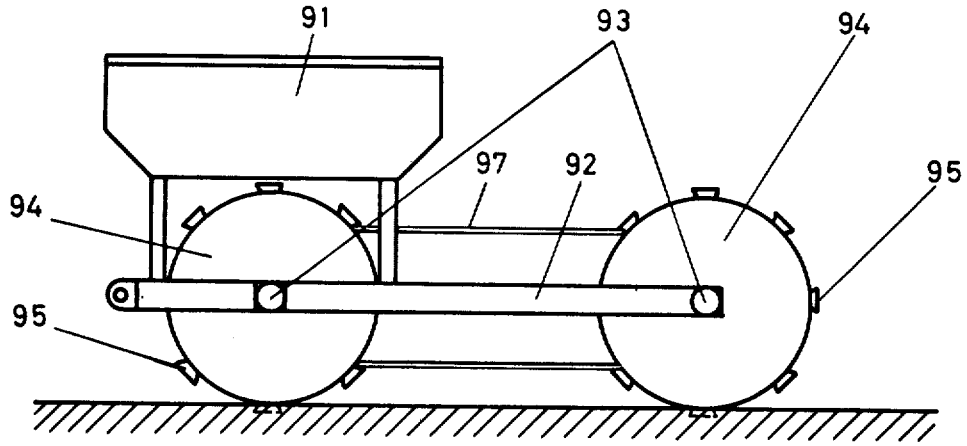
FIG. 9 is a side view of apparatus for defining the compactibility coefficient of the soil in soil compacting apparatus according to the invention.
Figure 10:
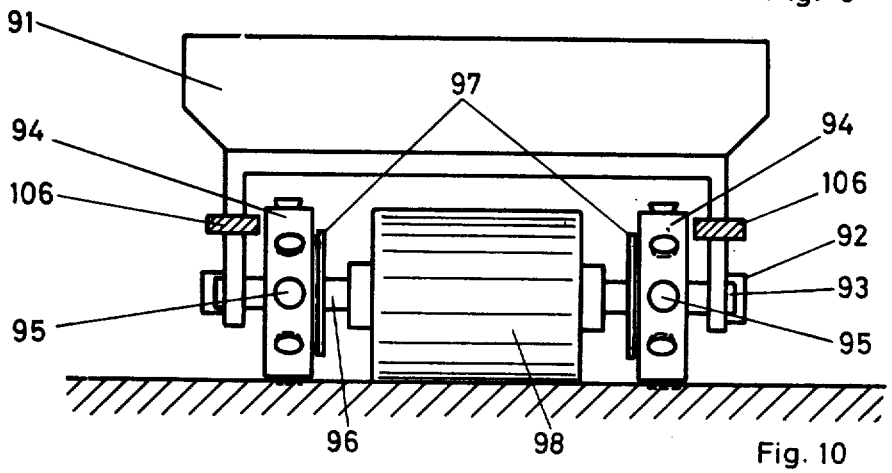
FIG. 10 is a front view of the apparatus of FIG. 9.
Figure 11:
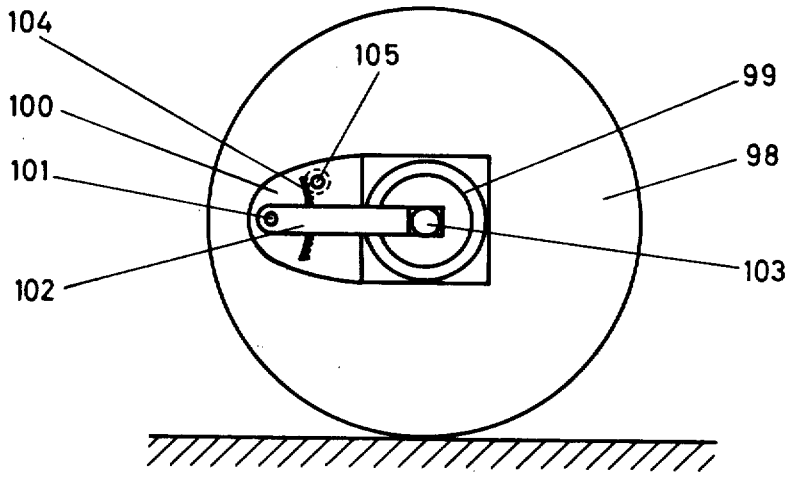
FIG. 11 shows a detail of the apparatus of FIG. 9.

FIGS. 9 to 11 refer to an embodiment of trailing measuring mean for determining the compactibility of a soil. The apparatus is constructed as a two-axle trailer, the axle which leads in the traveling direction being adapted to support a container 91 which may be filled with water or building material in order to provide adequate loading of the said axle. The two identically constructed axles of this apparatus have the following construction. Separate wheel discs 94 run on the right-hand and left-hand sides respectively of shafts 93 which are fixedly disposed at the frame 92 of the trailer. Thrust members in the form of tiltable rams 95 are disposed at equal distances from each other on the circumference of each said wheel disc. The wheel discs 94 are positively coupled to each other through a hollow shaft 96 and through a chain drive 97. Centrally on each shaft 93, the vehicle is provided with a smooth roller 98, having a hollow boss 99 on both sides which surrounds the hollow shaft 96 and which is coupled thereto through a flange 100, a universal joint 101 and a radius rod 102, the hollow shaft 96 being freely rotatable in the bearing 103 of the radius rod 102. The radius rod 102 supports a gear rim 104 in the shape of a circular sector and adapted to mesh with a gear wheel 105 the shaft of which is provided with measuring means, not shown, in the form of a distance transmitter.

This apparatus functions in the following manner. Under the effect of material filled into the container 91, the weight of said material acting through the frame 92 and the wheel axle 93 causes the front axle rams 95 located in the respective lowest position on the running discs 94 to penetrate into the soil, while the smooth roller 98 is guided by the radius rod 102 and rolls on the undisturbed soil surface. The angular position of the gear wheel 105 or the output of the measuring means driven thereby therefore represents a measure of the depth to which the rams 95 penetrate into the soil. Positive coupling of the front and rear trailer axle simultaneously provides a measured value for the penetration of rams 95 on the rear wheel discs at a position of the soil on which corresponding rams of the leading wheel discs had previously acted.

Figure 12:
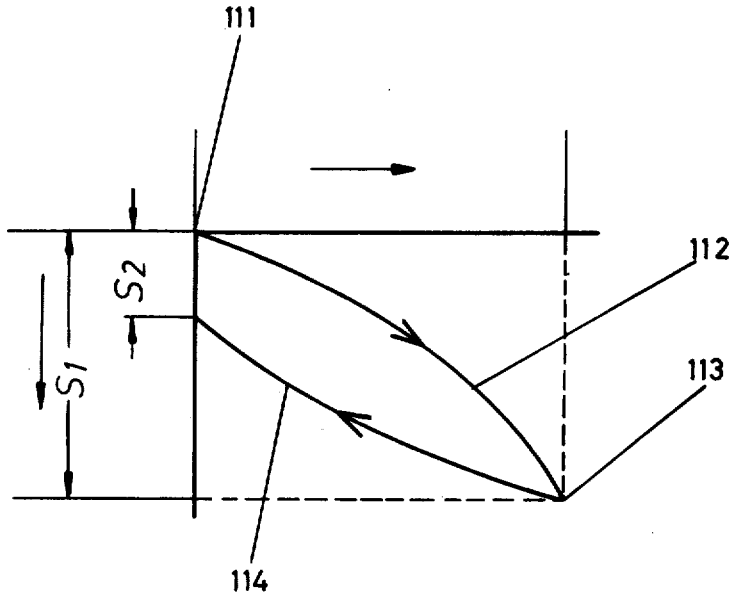
FIG. 12 is a diagram explaining the method of operation of the apparatus of FIGS. 9 to 11.

FIG. 12 illustrates these relations in a simple thrustset diagram. Staring from point 111 of this diagram, the curve 112 shows the penetration of rams on the loaded leading wheel discs into the soil to a maximum value 113 (set value) S1) which corresponds substantially to the traveling phase illustrated in FIG. 9. As the measuring apparatus continues to travel, the soil loading is reduced at this position and the set is reduced in accordance with the curve section 114 to a value S2 which is then measured by the rear wheel discs of the measuring trailer. The ratio of maximum set S1 to permanent set S2 or the reversible set S1–S2, evaluated by reference to the maximum loading, may be used to indicate the degree of compaction of the respective soil 25 and to form suitable measured values to serve the function of the signals supplied by measuring means 14 of the measuring and control system as shown in FIG. 2.

Figure 13:
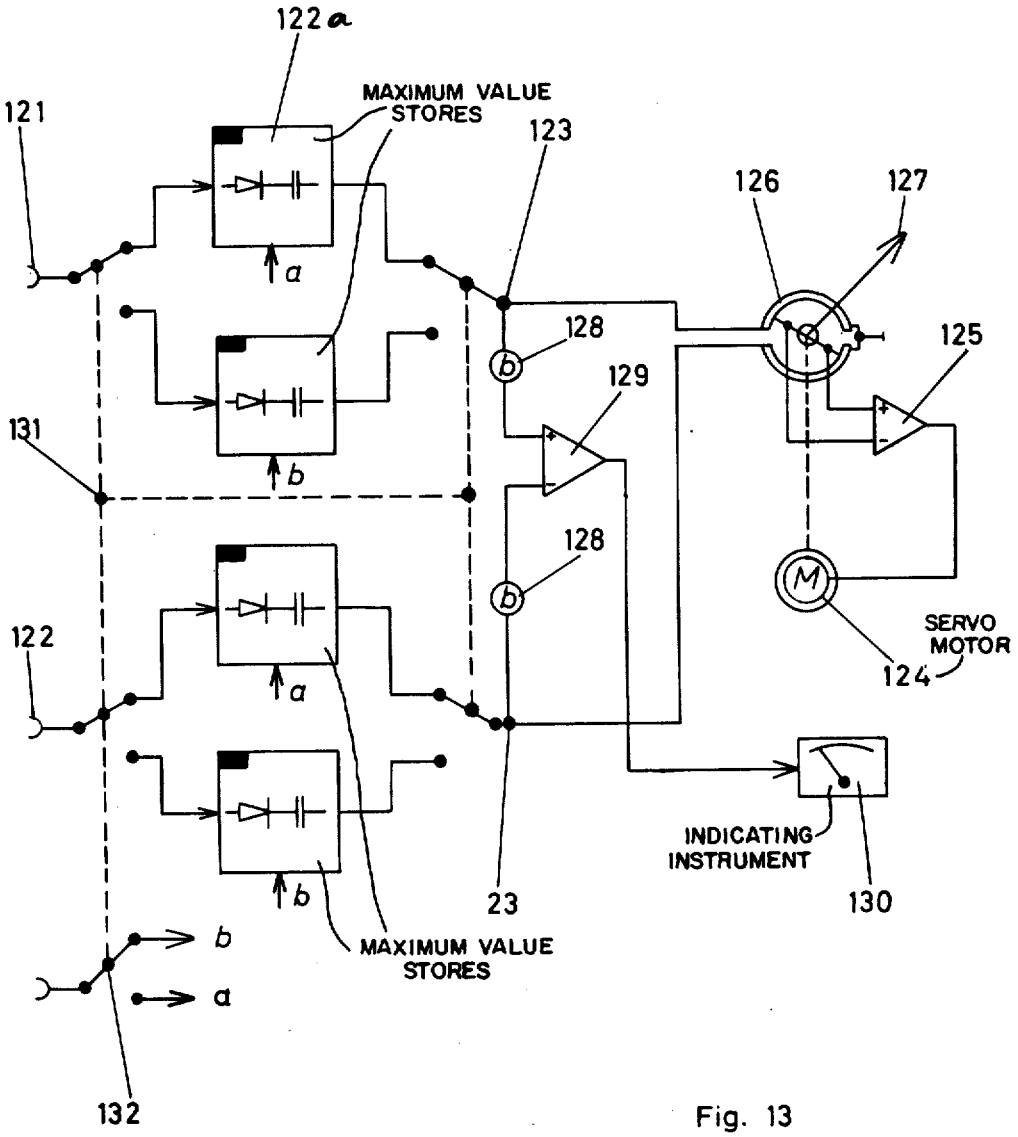
FIG. 13 is a schematic of a circuit employed in conjunction with the apparatus of FIGS. 9 to 12.

FIG. 13 shows a processing circuit for forming such measured values. The signal derived from the leading vehicle axle, reaches the input 121 of the circuit, the corresponding signal from the rear axle reaching the input 122.

These measured values are supplied to maximum-value stores **122*a* and from there pass to the junctions 123. This is utilized, in a first processing branch, to indicate the ratio through the angular position of the pointer 127, mounted on the potentiometer spindle of the double-wiper potentiometer 126 which is driven by the servomotor 124 through the differential amplifier 125. In a second processing branch the voltages are transferred from the junctions 123 through coefficient adjusting means 128, the characteristics of which are set by the loading represented by the container 91, to a differential amplifier 129 and from there to an indicating instrument 130. The embodiment also incorporates a stepping switch 131, of which only two switching positions are shown in FIG. 13 and which generally contains as many switching positions as there are impressions of the leading trailer axle produced in the soil between said axle and the trailing in accordance with the length of the trailer. According to FIG. 10, the stepping switch is controlled by pulse transmitters 106 which are mounted on the vehicle frame 92 so that cyclic indexing of the stepping switch occurs always at the moment at which the next rams on the leading trailer axis makes contact with the soil (in FIG. 10 the said pulse transmitters are disposed on the interior of the frame 92 near the periphery of the leading wheel disc). The pulse transmitters 106 may take the form of reed switches which are operated by magnets disposed on the exterior of the wheel discs 94 between the rams 95. In an additional switching deck 132, according to FIG. 13**, these pulses are additionaly fed to the cancelling inputs of the maximum-value stores which are connected during the preceding pulse interval.

Figure 14:
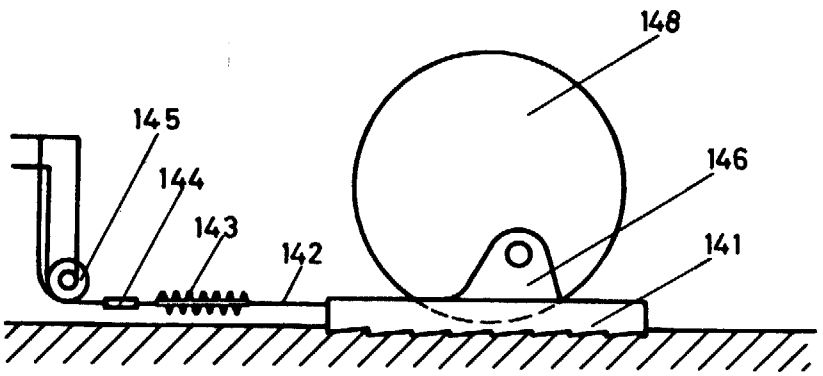
FIG. 14 is a side view of measuring means for defining the shear strength of the soil to be compacted in soil compacting apparatus according to the invention.
Figure 15:
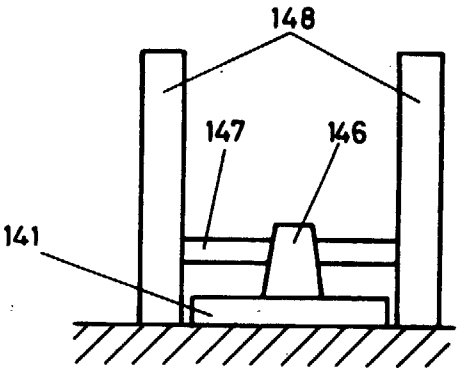
FIG. 15 is a rear view of the measuring means of FIG. 14.
Figure 16:
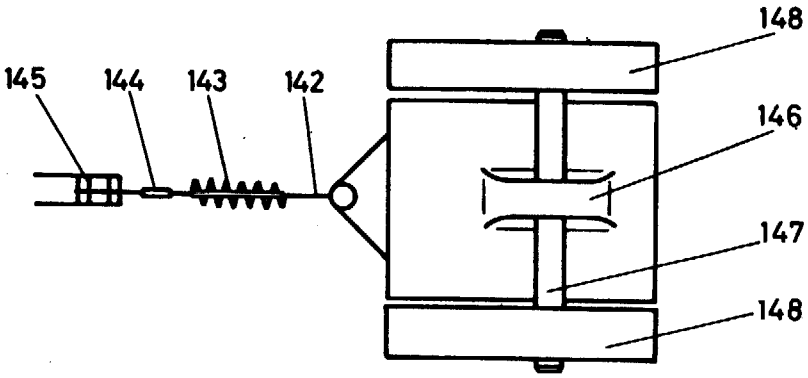
FIG. 16 is a plan view of the measuring means of FIGS. 14 and 15.

FIGS. 14 to 16 show an embodiment of trailing measuring means for determining the shear strength of the compacted soil. The means comprise a thrust plate 141, serrated on the underside. It is pulled by the steered roller 145 of the leading compacting vehicle from a trail rope 142 and through a damped spring 143 and force sensor 144. The thrust plate 141 supports an axle bearing 146 with an axle 147 on which two rigidly coupled running wheels 148 are eccentrically disposed so that when the thrust plate 141 is at rest, the torgue produced by the gravitational force of the running discs 148 causes these to rotate forwardly in the traveling direction of the compacting apparatus so that they bear on the soil laterally adjacent of the thrust plate. The force sensor 144 measure the force transmitted through the trail rope 142 to the thrust plate 141. This force increases while the spring 143 is extended until the shear strength of the soil below the thrust plate 141 is exceeded. At this moment the signal amplitude of the force sensor 144 will drop spontaneously accompanied by the beginning of a rolling motion of the running disc 148 which raise the thrust plate 141 from the soil and, in accordance with their diameter, move the said plate forwardly in the traveling direction by at least one plate length and then once again place it on the soil. The controlled variable is the peak value of the signal emitted by the force sensor 144, said peak value being transferred to a store in accordance with store 13 of FIG. 2.

Figure 17:
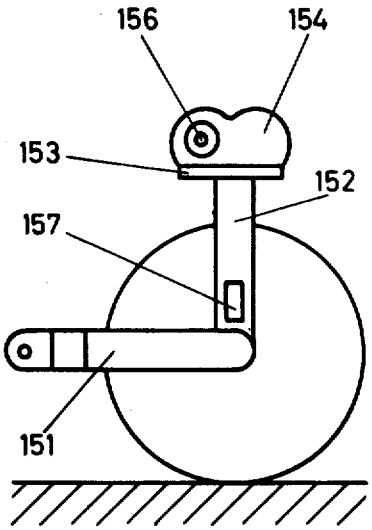
FIG. 17 is a side view of measuring means for defining the continuous vibration impedance of the soil in soil compacting apparatus according to the invention.
Figure 18:
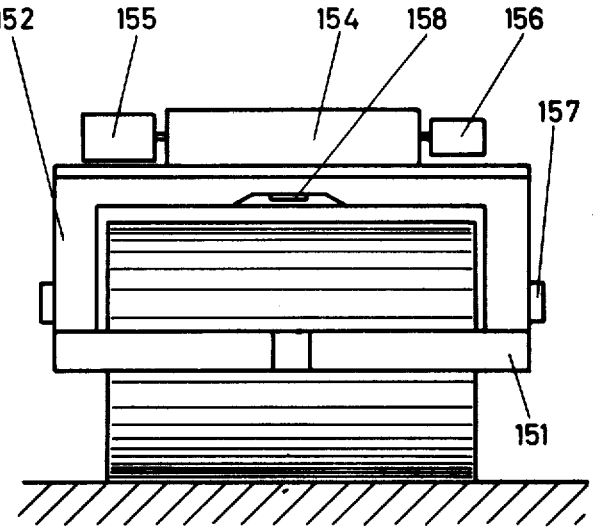
FIG. 18 is a front view of the measuring means of FIG. 17.

FIGS. 17 and 18 show an embodiment of trailing measuring means for determining the continuous vibration impedance of the compacted soil. The said measuring means comprise a single-axle roller drawn by the compacting apparatus. In addition to its drawbar 151, said single-axle roller incorporates a loading bar 152, journaled on the roller axle and supporting on its upper platform 153 a directional force generator 154 the principal operative direction of which is vertical. The numeral 155 refers to the drive for the aforementioned directional force generator while the numeral 156 refers to an angle position transmitter, rigidly coupled to the rotor shafts of the generator. Near each of the roller axle ends the loading bar 152 is also provided with an acceleration pick-up 157 with a vertical operative direction and, centrally below the directional force generator, an elongation transducer 158 disposed in a reduced cross-sectional zone.

Figure 19:
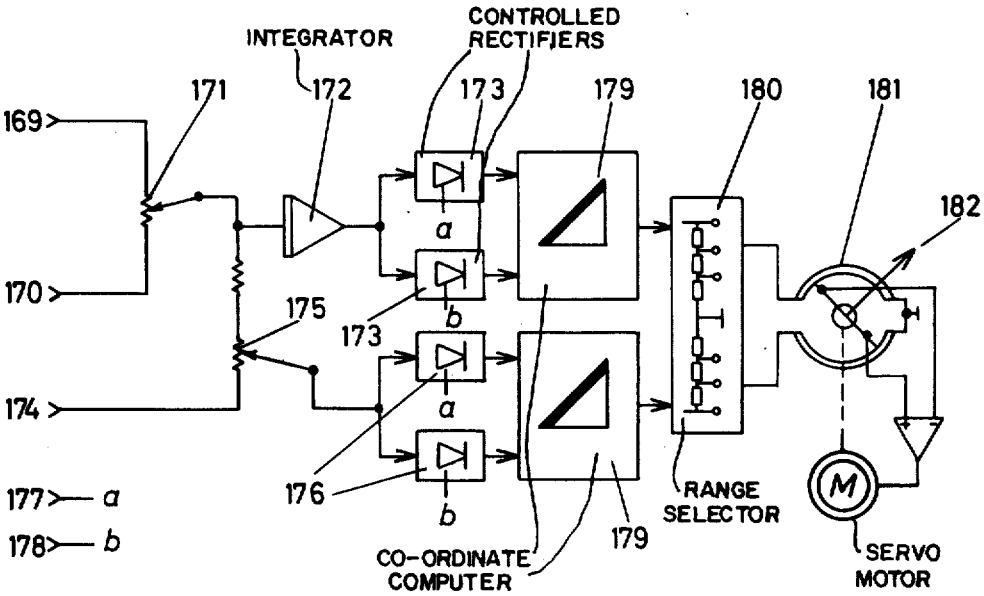
FIG. 19 is a schematic of the circuit used in conjunction with the measuring means of FIGS. 17 and 18.

FIG. 19 shows an embodiment of the associated processing circuit. The signals of the acceleration pick-ups 157 are supplied to the inputs 169 and 170 of the aforementioned circuit, the summated voltage of said signals being tapped off by an adjustable potentiometer 171 which connects the inputs 169, 170. The summated voltage is integrated by an integrator 172 and supplied to the inputs of the controlled rectifiers 173. The signal of the elongation transducer 158 is supplied to the input 174, said signal being supplied to the inputs of the controlled rectifier 176 after having superimposed upon it a portion of the summated voltage obtained from the tapping of the adjustable potentiometer 175. The control voltages of the said rectifiers are derived by means of pulse-forming stages, not shown, from the output signals of the phase angle transmitters 156 and are supplied to the circuit through the input sockets 177 and 178. These two square-wave voltages are phase-displaced relative to each other by one quarter of their cycles. The present embodiment dispenses with phase data relating to the continuous vibration impedance and merely responds to its total amount. To this end, the output voltages of the controlled rectifiers 173 and 176 are supplied in pairs to separate co-ordinate computers 179, the output voltage of which varies with respect to the output voltages of the controlled rectifiers 173 and 176 in the same way as the hypotenuse of a right-angle triangle varies with the length of the short sides thereof. The voltages thus obtained are supplied through a range selector 180, covering both channels, to quotient indicating means comprising potentiometer 181 of the kind already described with reference to FIG. 13. The position of the pointer 182 thus corresponds to the amount of continuous vibration impedance of the compacted soil at the frequency of the directional force generator 154 and forms the measured value of the measuring means 14 of the control system of FIG. 2 or, respectively, as indicated by indicating means 9 of the double vibratory roller 1 in FIG. 1.

Figure 20:
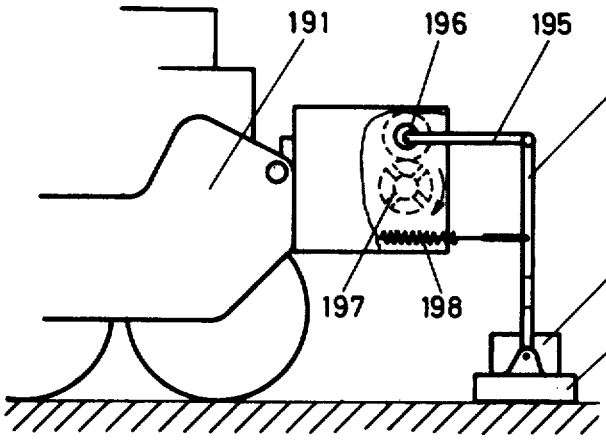
FIG. 20 is a side view of measuring means for defining the pulse or impact impedance of the soil in soil compacting apparatus according to the invention.
Figure 21:
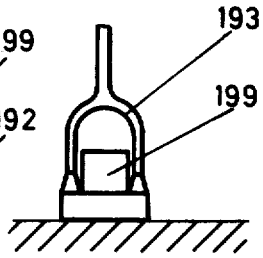
FIG. 21 is a front view of a detail of the measuring means of FIG. 20.

FIGS. 20 and 21 refer to an embodiment for trailing measuring means adapted to obtain a measured value which is characteristic for the pulse or impact impedance of the compacted soil. The numeral 191 refers to a greatly simplified rearward part of compacting apparatus 24; this supports tamping means in which the drop weight 192 is mounted on a bracket 193 at one end of a guide rod 194 and may be raised by means of a lever 195. Lever 195 is rigidly coupled to a gear wheel 196 adapted to mesh with a gear wheel 197 the tooth system of which is sub-divided into segments. The guide rod 194 hinged to the lever 195, is guided in the traveling direction by a spring damping element 198. If the segmented gear wheel 197 is driven at a moderate and constant angular velocity, it will first raise the drop weight 192 on the guide rod 194, by virtue of a rotation of the gear wheel 196 and the lever 195 coupled thereto, and then allow it to drop instantaneously when the gear wheels 197 and 196 are out of mesh. During the contact phase the spring damping element 198 absorbs the increasing distance resulting from the traveling motion of the compacting apparatus 24 which will be compensated for during the succeeding lift period of the drop weight 192. An acceleration pick-up 199 having a vertical operating direction is disposed on the drop weight below the bracket 193.

Figure 22:
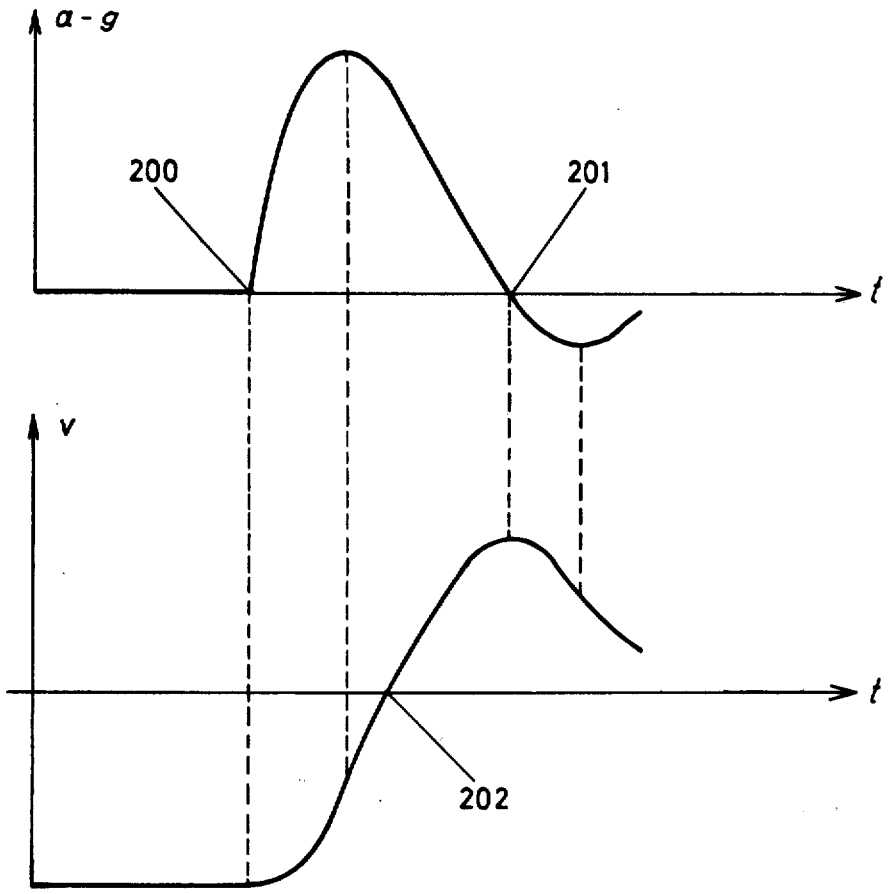
FIG. 22 is a diagram of the signal flow to explain the method of operation of apparatus according to FIGS. 20 and 21.

The kinematic conditions accompanying operation of the aforementioned measuring means are illustrated in FIG. 22. The upper diagram shows the output signal of the acceleration pick-up 199 as a function of time, corresponding to the difference between effective acceleration and gravitational acceleration. The first part of the curve to the moment of time 200 therefore corresponds to the dropping motion of the drop weight 192. At the moment of time at which contact is made with the soil, a substantially upwardly directed acceleration occurs but rapidly decreases and, after moment of time 201, and in accordance with the soil characteristics, returns in a more or less damped oscillation to the initial value, the said soil characteristics being of no interest for the measured value to be obtained in this context.

The lower diagram represents a velocity signal as derived from the upper diagram. This signal is constant for a first period of time, that is to say during the trajectory phase, said constant level corresponding to the impact velocity of the drop weight 192. This variable tends towards zero in accordance with the substantial positive acceleration after moment of time 200, the zero line being reached at the moment of time 202 and then being exceeded which is of no interest in the present case.

Figure 23:
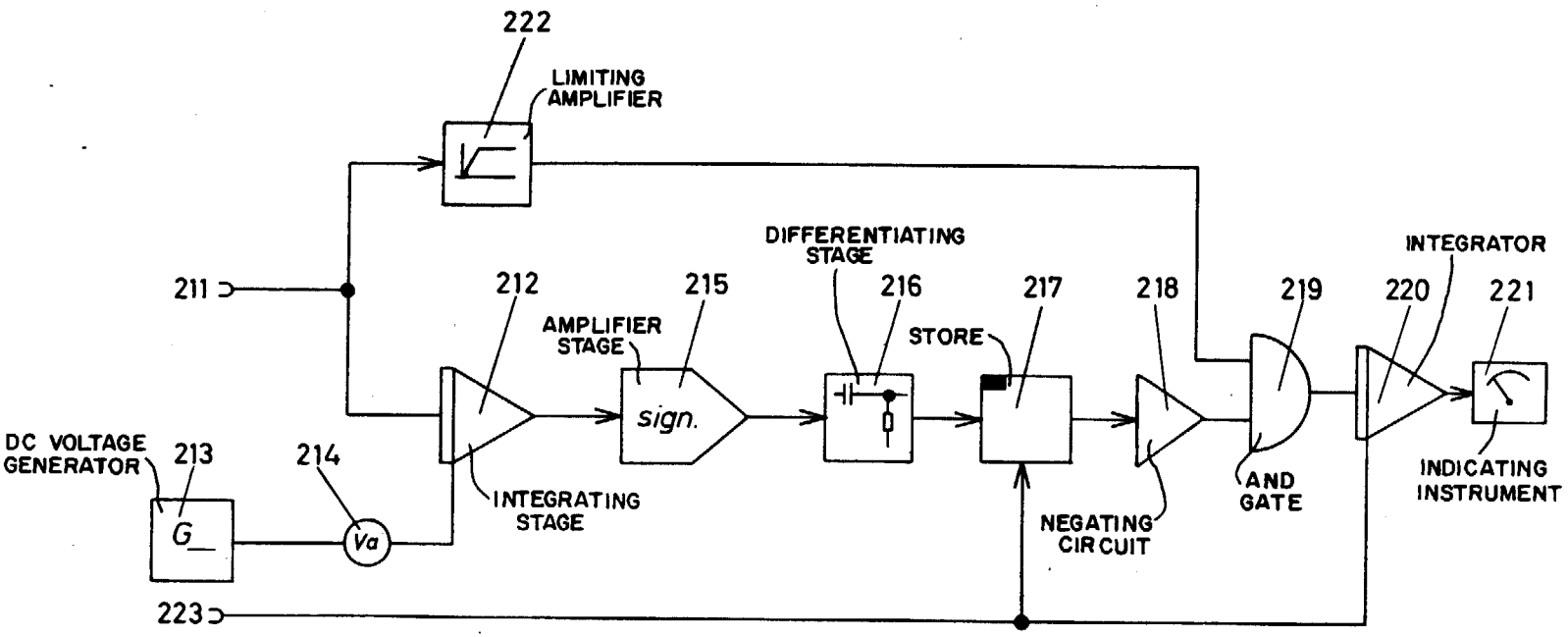
FIG. 23 is a schematic of a circuit used in conjunction with the measuring means of FIGS. 20 and 21.

FIG. 23 relates to an embodiment of a related processing circuit. The signal of the acceleration pick-up 199 is supplied to the input 211. In the main branch of this system the signal is supplied to the integrating stage 212 which is supplied with its initial value from the dc voltage generator 213 through a coefficient adjuster 214. The adjuster 214 is set so that the initial value corresponds to the impact velocity as derived from the drop height of the drop weight 192. The succeeding stage 215 performs signal amplification with a high gain and peak limitation and therefore functions as a signum. The store 217 is supplied from the following differentiating stage 216. After processing by the negating circuit 218 the store output signal is supplied to a further integrator 220 via AND gate 219. The output integrator 220 appears on the indicating instrument 221 which corresponds to indicating means 9 at the double vibratory roller 1 in FIG. 1. The AND gate 219 on the other hand is controlled by the acceleration signal from a limiting amplifier 222 so that integration by the integrator 220 will proceed only if the acceleration signal is positive. This ensures that in correspondence with the lower diagram in FIG. 22 integration will only occur during the period of time between moments 200 and 202. After moment of time 202, the pulse input 223 of the circuit is supplied, by means not shown, with a cancelling pulse for the store 217 and for resetting the integrator 220 to the initial value zero. The signal applied to indicating instrument 221 also may be applied to the measuring and control system shown in FIG. 2 as the measured value of the measuring means 14.

Figure 24:
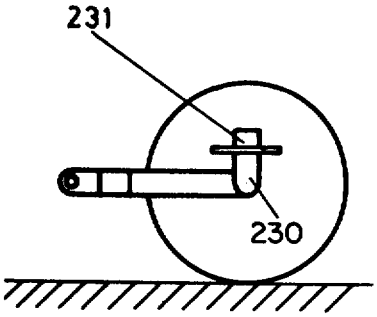
FIG. 24 is a side view of further measuring means for soil compacting apparatus according to the invention.
Figure 25:
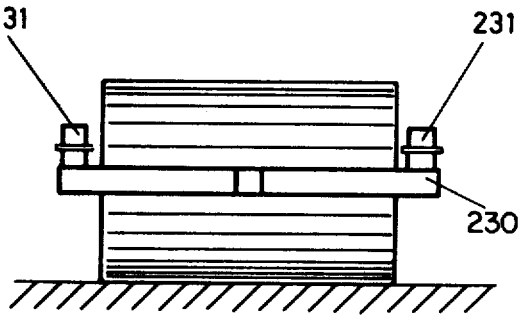
FIG. 25 is a front view of the embodiment of FIG. 24.
Figure 26:
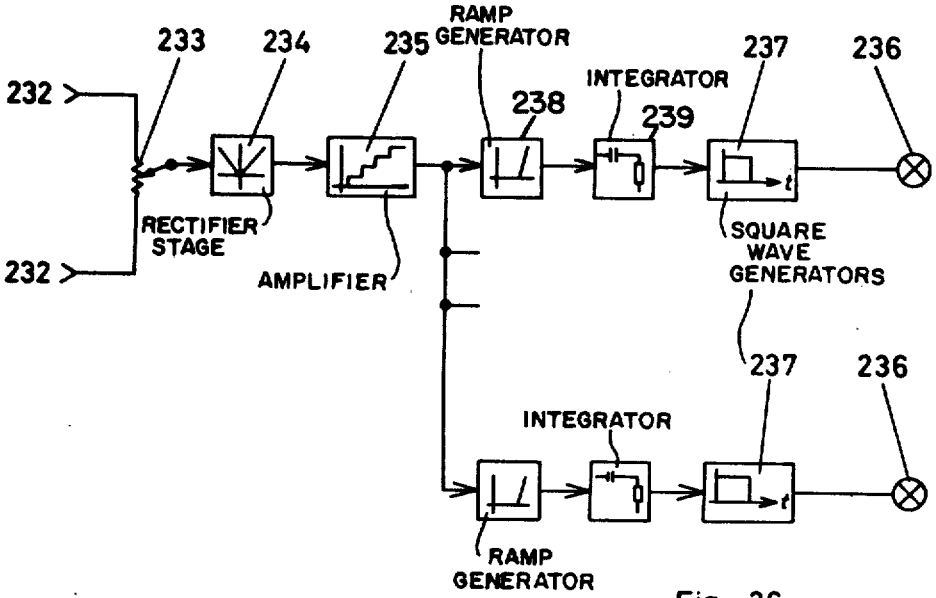
FIG. 26 is a schematic of a circuit used with the measuring means of FIG. 24.

FIGS. 24, 25 and 26 show a further embodiment for trailing measuring means. The measuring means comprise a single axle roller, trailing the compacting apparatus 24. A frame 230 is journaled on theaxle trunnions and, at both sides, supports acceleration pickups 231. The signals of these acceleration pick-ups are supplied to the two inputs 232 of the processing circuit shown in FIG. 26 and tapped off from an adding potentiometer 233 in the form of a summated voltage, are then rectified in the stage 234 and supplied to an amplifier 235 with multipoint characteristics. The following stages in the circuit comprise basically classifying means, indicating means 236 for the individual grades driven by timing elements (comprising a ramp generator 238, an integrator 239 and a square wave generator 237) which suppress the indication of a respective grade value if the same is not repeated within a given period of time. The signals at indicating means 236 which may serve as indicating means 9 in the double vibratory roller 1 as shown in FIG. 1 may be supplied as the measured values of the measuring means 14 the measuring and control system as represented in FIG. 2.

Figure 27:
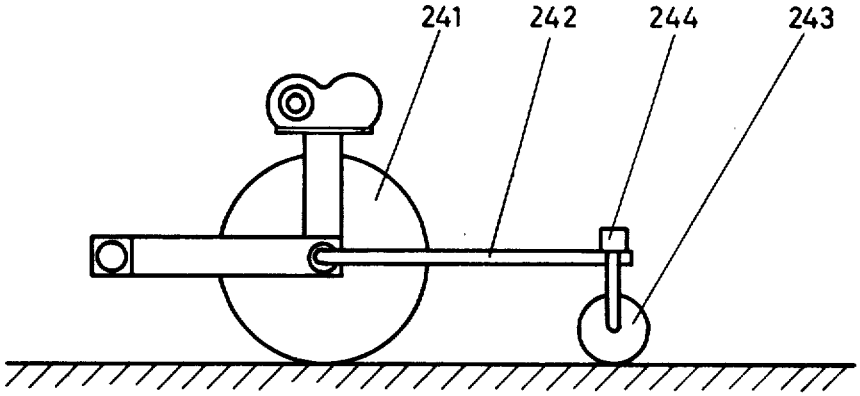
FIG. 27 is a side view of a further embodiment.

FIG. 27 shows an embodiment for of trailing measuring means for determining the propagation conditions of surface waves on the compacted sub-grade. The numeral 241 refers to single axle roller 241 identical in construction with the measuring means as illustrated in FIGS. 17 and 18 except for the measuring roller 243. Light-weight measuring roller 243 is provided in vertical configuration above the roller axle and on both sides with separate acceleration pick-ups 244 of vertical operating direction. The roller is drawn by means of a drawbar 242. Reference may also be made to FIG. 19 as regards the associated processing circuit, however the superimposing element of that circuit is omitted and the input is connected directly to the two controlled rectifiers. The indication provided by the pointer will then correspond to the amount of the ratio of the vertical vibration velocity of the soil occurring at the position of measuring roller 243 to the excitation intensity introduced by the roller 241.

Figure 28:
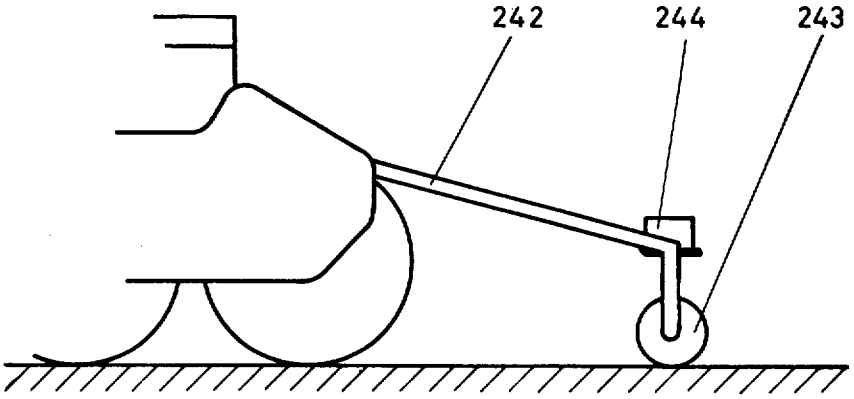
FIG. 28 is a side view showing a modification of the embodiment of FIG. 27.

FIG. 28 shows a simplification of the embodiment in the event that the compacting apparatus is a vibration apparatus adapted to operate top load mode, for example a duplex roller. The angular position transmitter 196 as in FIG. 20 is mounted on the unbalance exciter of the said compacting apparatus. The output signals of the transmitters are supplied to control inputs 177, 178 of the rectifiers 173, 176; see FIG. 19.

We claim:

1. A soil compacting apparatus movable along a path and having a compacting element, control means by which at least one of the operational parameters determining the compacting action by said soil compacting apparatus may be varied and measuring means responsive to a selected physical parameter of the soil, the improvement comprising:

said measuing means trailing said compacting element and moved by the soil compacting apparatus along said path after the soil on the path has been acted upon by the compacting element and producing a measured value signal related to the degree of compaction of the soil in said path;

said control means including an adjustable fixed-value transmitter for producing a command signal;

adding means connected to receive said command signal and said measured value signal to produce a difference output signal therefrom;

transfer signal generating means to generate a transfer signal relating a change in said difference output signal to the corresponding change in said at least one operational parameter;

a multiplier stage having two inputs, means connecting a first of its inputs to said adding means and the second of its inputs to said transfer signal generating means so that said multiplier stage receives said difference output signal and said transfer signal and produces a control signal;

a converter connected to receive said control signal and generating a driving signal for adjusting said at least one operational parameter of said soil compacting apparatus in accordance with said control signal, whereby said at least one operational parameter may be varied in response to said measured value signal to produce a relatively uniform compaction of said oil in said path as said soil compacting apparatus moves along said path.

2. A soil compacting apparatus as set forth in claim 1, wherein said transfer signal is a fixed voltage.

3. A soil compacting apparatus as set forth in claim 2, including another measuring means leading said compacting element and connected to and moved by the soil compacting apparatus along said path before the soil in the path has been acted upon by the compacting element, said other measuring means including a measuring transducer for producing another measured-value signal related to a selected physical characteristic of the soil, delay means for producing a time-delay in a signal received thereby, means connecting the delay means to the other measuring means for supplying said other measured-value signal to said delay means whereby said delay means produces a time-delayed, other-measured-value signal, and means connecting said delay means to said adding means to supply said time-delayed, other-measured-value signal to said adding means so that said difference output signal is modified thereby.

4. A soil compacting apparatus as set forth in claim 3, wherein said selected physical characteristic is the degree of compaction of the soil.

5. A soil compacting apparatus as set forth in claim 3, wherein said selected physical characteristic is water content of the soil.

6. A soil compacting apparatus as set forth in claim 3, wherein the two measuring means are spaced a given distance apart and the time-delay of said delay means corresponds to the time required for the apparatus to traverse a distance corresponding to said given distance.

7. A soil compacting apparatus as set forth in claim 1, including generator means having a trigger input and producing a command feed-forward signal when a signal is received at said trigger input;

wherein said adding means comprises a first adding element having two inputs and an output one of which inputs receives said command signal and the other of which inputs is connected to receive said command feed-forward signal, said adding element supplying said command signal to said output and additionally said command feed-forward signal when a signal is received at said trigger input of said generator means, and an adding stage having two inputs and an output one of which inputs is connected to said adding element output and the other of which is connected to receive said measured value signal, said adding stage producing said difference output signal at the output thereof; and wherein said transfer signal generating means comprises pulse triggered timer means having a trigger input and a pulse output and having a set time equal to one said command feed-forward signal pulse, pulse generator means having minimum value limiting connected to receive said difference output signal and to produce an output pulse, means connecting the pulse generator means to said trigger inputs of said command feed-forward signal generator means and said timer means, first store means having a reset input connected to the pulse output of said timer means and an input connected to said output of said adding element to receive said command signal therefrom, second store means having a reset input connected to the pulse output of said timer means and a signal input, means connecting said signal input of said second store means to said measuring means for supplying said measured signal to said second store means, a second adding element connected to said first store means and to the output of said first adding element for producing a difference signal, a third adding element connected to said second store means and to said means connecting said second store means and said measuring means to receive said measured signal for producing a difference signal, another multiplier stage connected to said second and third adding elements to receive said difference signals therefrom for producing said transfer signal, a timer controlled gate connected to receive said output pulse from said pulse triggered timer means and rendered nonconductive during the set time thereof, said gate having an input and an output, means connecting said gate input to said other multiplier stage to supply said transfer-signal to said gate input, a transfer signal holding element connected to the output of said gate, and means connecting said transfer signal holding element to said second input of the first mentioned multiplier stage.

8. A soil compacting apparatus as set forth in claim 7, wherein said adding stage has a third input, and including another measuring means leading said compacting element and connected to and moved by the soil compacting apparatus along said path before the soil in the path has been acted upon by the compacting element, said other measuring means including a measuring transducer for producing another measured-value signal related to a selected physical characteristic of the soil, delay means for producing a time-delay in a signal received thereby, means connecting the delay means to the other measuring means for supplying said other measured-value signal to said delay means whereby said delay means produces a time-delayed, other measured-value signal, and means connecting said delay means to said third input of said adding stage to supply said time-delayed, other-measured-value signal to said adding stage so that said difference output signal is modified thereby.

9. A soil compacting apparatus as set forth in claim 8, wherein said selected physical characteristic is the degree of compaction of the soil.

10. A soil compacting as set forth in claim 8, wherein said selected physical characteristic is water content of the soil.

11. A soil compacting apparatus as set forth in claim 8, wherein the two measuring means are spaced a given distance apart and the time-delay of said delay means corresponds to the time required for the apparatus to traverse a distance corresponding to said given distance.

* * * * *